US007406930B2

(12) United States Patent
Banke

(10) Patent No.: US 7,406,930 B2
(45) Date of Patent: Aug. 5, 2008

(54) VARIABLE DISPLACEMENT MECHANISM FOR INTERNAL COMBUSTION ENGINE

(76) Inventor: Donald W. Banke, 21562 NW. Dairy Creek Rd., North Plains, OR (US) 97133

( * ) Notice: Subject to any disclaimer, the term of this patent is extended or adjusted under 35 U.S.C. 154(b) by 8 days.

(21) Appl. No.: 11/676,477

(22) Filed: Feb. 19, 2007

(65) Prior Publication Data

US 2008/0163847 A1 Jul. 10, 2008

(51) Int. Cl.
*F02B 75/04* (2006.01)

(52) U.S. Cl. ..... 123/48 B; 123/78 F

(58) Field of Classification Search ..... 123/48 B, 123/78 E, 78 F

See application file for complete search history.

(56) References Cited

U.S. PATENT DOCUMENTS 2,209,012 A * 7/1940 Barkeij ..... 123/48 B
2006/0086336 A1 4/2006 Pekau

* cited by examiner

*Primary Examiner*—Noah Kamen
(74) *Attorney, Agent, or Firm*—John Smith-Hill; Smith-Hill and Bedell

(57) ABSTRACT

An internal combustion engine includes a cylinder structure in which a crankshaft assembly is journalled for rotation about a main axis of a main crankshaft segment having a main axis. A crank web is attached to the main crankshaft segment and projects from the main crankshaft segment, and a crank pin structure is attached to the crank web and has a central axis that is parallel to the main axis and is spaced from the main axis by a distance D. A first mechanism attaches the inner end of a connecting rod to the crank pin structure and permits substantially longitudinal movement of the connecting rod relative to the crank pin structure. A second mechanism permits selective adjustment of the distance D. The second mechanism is coupled to the first mechanism in a manner such that an increase in the distance D is associated with longitudinal movement of the connecting rod toward the central axis of the crank pin structure and a decrease in the distance D is associated with longitudinal movement of the connecting rod away from the central axis of the crank pin structure.

13 Claims, 3 Drawing Sheets

VARIABLE DISPLACEMENT MECHANISM FOR INTERNAL COMBUSTION ENGINE

BACKGROUND OF THE INVENTION

This invention relates to a variable displacement mechanism for an internal combustion engine.

FIGS. 1 and 1A illustrate in simplified form a conventional radial engine. The engine shown in FIGS. 1 and 1A comprises a main cylinder structure 2 defining five cylinders 4 and journaling a crankshaft 6. Five pistons 8 are fitted in the cylinders respectively and are connected to the crankshaft by respective connecting rods 10. As the pistons reciprocate in the cylinders in phased relationship, the crankshaft rotates relative to the main cylinder structure.

The stroke of the piston depends on the eccentricity of the crankshaft. In the conventional radial engine, the eccentricity of the crankshaft, and hence the stroke of the piston, is fixed.

The power output and fuel consumption of an internal combustion engine depends on the engine displacement, i.e. the volume that is swept by the pistons during one complete cycle. In order to minimize fuel consumption, it would be desirable to be able to adjust the displacement of an internal combustion engine depending on operating conditions.

One approach to adjusting the engine displacement depending on operating conditions has been to interrupt fuel supply to one or more cylinders in low load conditions so that combustion takes place in fewer than all the cylinders of the engine. This and other approaches to varying engine displacement have not generally met commercial success.

SUMMARY OF THE INVENTION

According to a first aspect of the present invention there is provided an internal combustion engine comprising a cylinder structure defining a combustion cylinder having a central axis, a piston fitted slidingly in the combustion cylinder for reciprocation therein, a crankshaft assembly including a main crankshaft segment having a main axis, a crank web that is attached to the main crankshaft segment and projects from the main crankshaft segment, and a crank pin structure that is attached to the crank web and has a central axis that is parallel to said main axis and is spaced from said main axis by a distance D, the crankshaft assembly being journalled in the cylinder structure for rotation about said main axis, an elongate connecting rod extending substantially radially of the crank pin structure and having an outer end attached to the piston and also having an inner end, a first mechanism attaching the inner end of the connecting rod to the crank pin structure, whereby reciprocation of the piston induces rotation of the crankshaft structure about said main axis, and a second mechanism for selectively adjusting the distance D, and wherein the first mechanism permits substantially longitudinal movement of the connecting rod relative to the crank pin structure, and wherein the second mechanism is coupled to the first mechanism in a manner such that an increase in the distance D is associated with longitudinal movement of the connecting rod toward the central axis of the crank pin structure and a decrease in the distance D is associated with longitudinal movement of the connecting rod away from the central axis of the crank pin structure.

According to a second aspect of the present invention there is provided a radial-piston internal combustion engine comprising a cylinder structure defining a primary combustion cylinder and a plurality of secondary combustion cylinders, each combustion cylinder having a cylinder axis extending radially of a central axis and the cylinder axes being angularly spaced from each other about the central axis, a primary piston fitted slidingly in the primary combustion cylinder for reciprocation therein, a plurality of secondary pistons fitted slidingly in the secondary combustion cylinders respectively for reciprocation therein, a crankshaft assembly including a main crankshaft segment having a main axis that coincides with the central axis of the cylinder structure, a crank web that is attached to the main crankshaft segment and projects from the main crankshaft segment, and a primary rod journal that is attached to the crank web and has a central axis that is parallel to said main axis and is spaced from said main axis by a distance D, the crankshaft assembly being journalled in the cylinder structure for rotation about said central axis, a primary connecting rod extending substantially radially of the primary rod journal and having an outer end attached to the primary piston and also having an inner end, a first mechanism attaching the inner end of the connecting rod to the primary rod journal, whereby reciprocation of the primary piston induces rotation of the crankshaft assembly about said central axis, a plurality of secondary connecting rods connecting the secondary pistons respectively to the primary rod journal, and a second mechanism for selectively adjusting the distance D, and wherein the first mechanism permits movement of the primary connecting rod relative to the primary rod journal substantially radially of the primary rod journal, and wherein the second mechanism is coupled to the first mechanism in a manner such that an increase in the distance D is associated with movement of the primary connecting rod toward the central axis of the primary rod journal and a decrease in the distance D is associated with movement of the primary connecting rod away from the central axis of the primary rod journal.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1A:
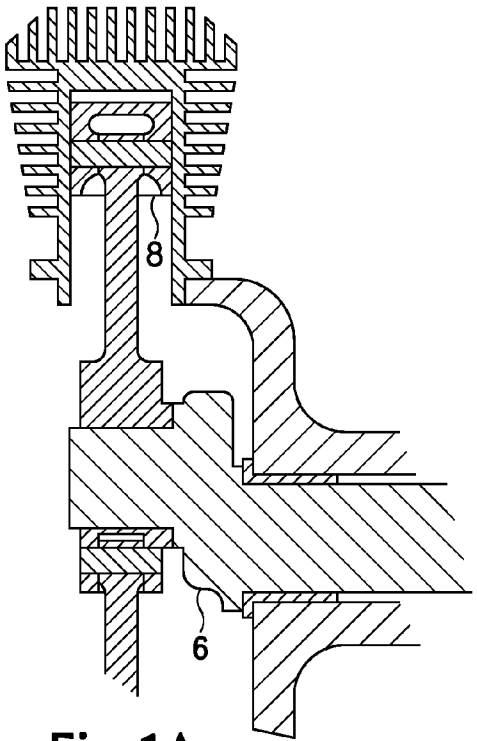
Fig.1A PRIOR ART
FIG. 1A is a sectional view taken on the line A-A of FIG. 1.
Figure 1:
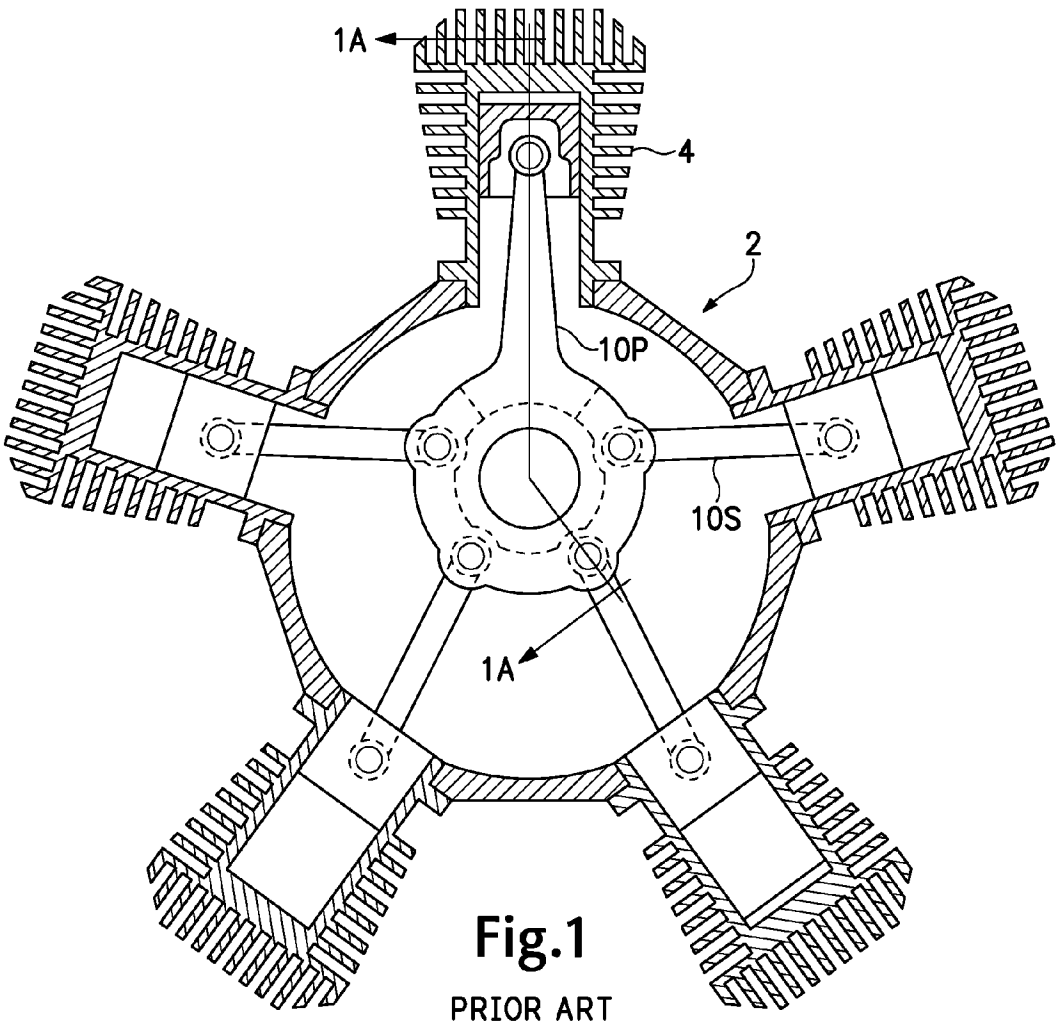
Fig.1 PRIOR ART
FIG. 1 is a schematic view of a conventional radial engine.
Figure 2:
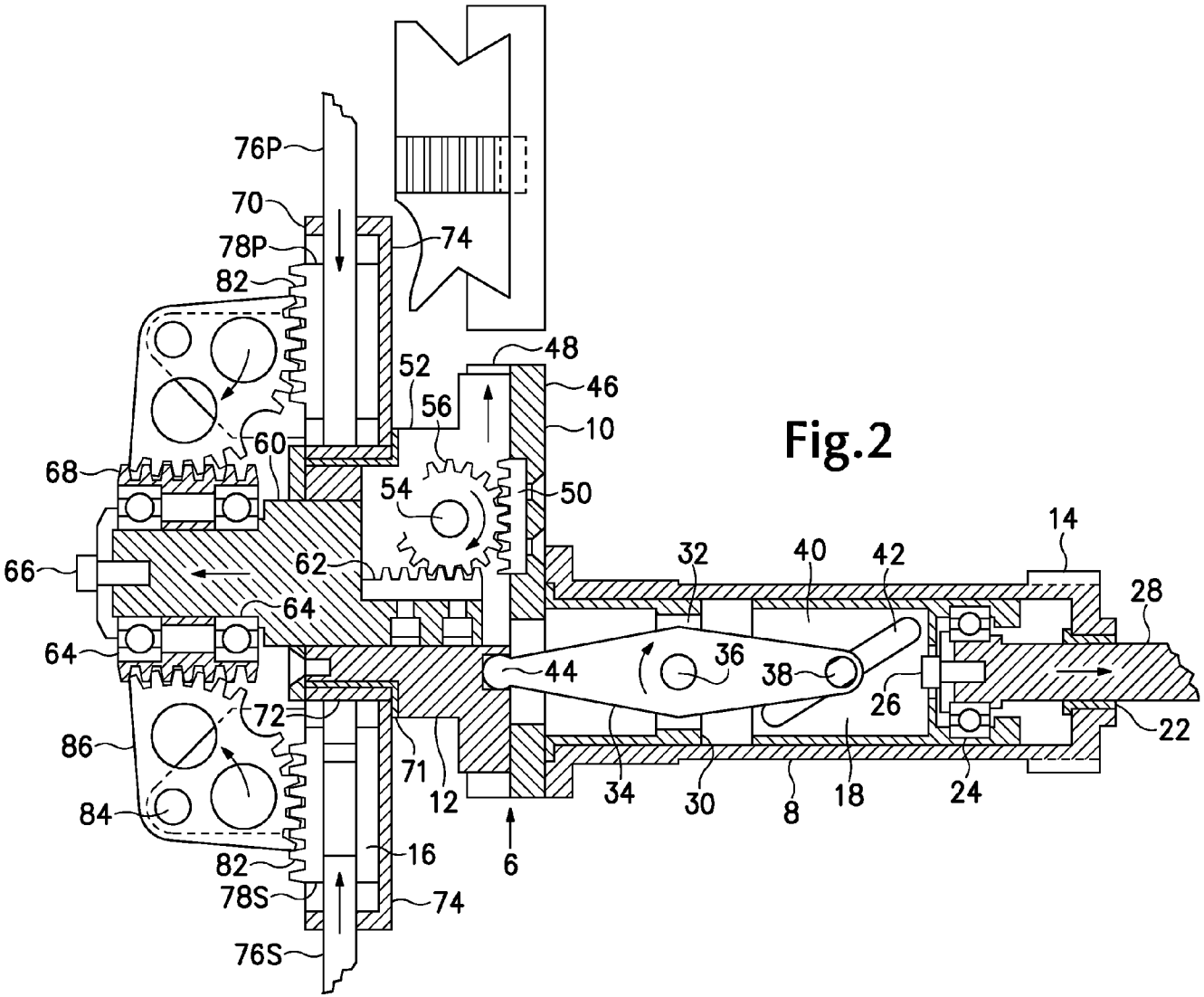
FIG. 2 is a sectional view of the crankshaft of an internal combustion engine embodying the present invention.
Figure 3:
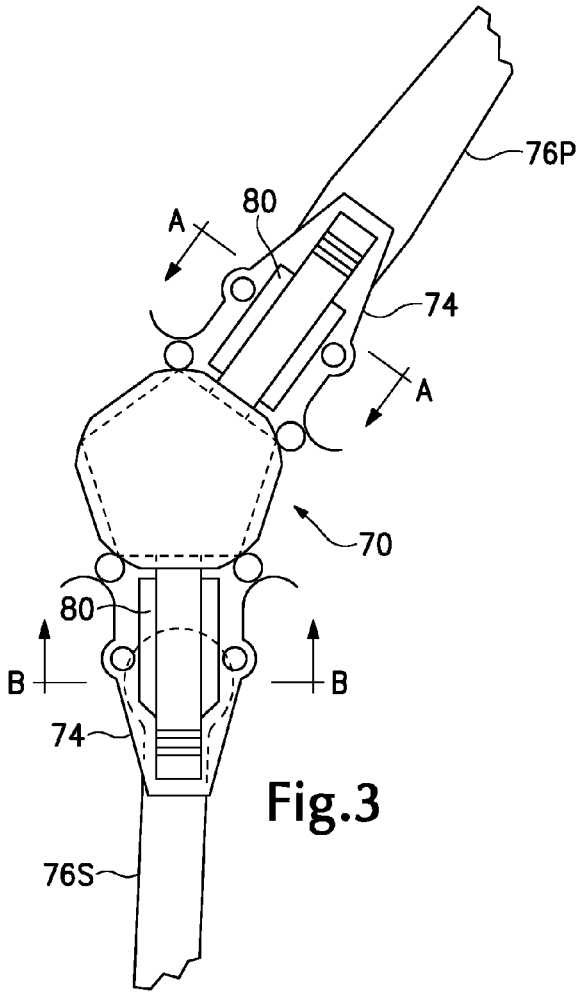
FIG. 3 is a partial end view illustrating the spindle post and two connecting rods.
Figure 3A:
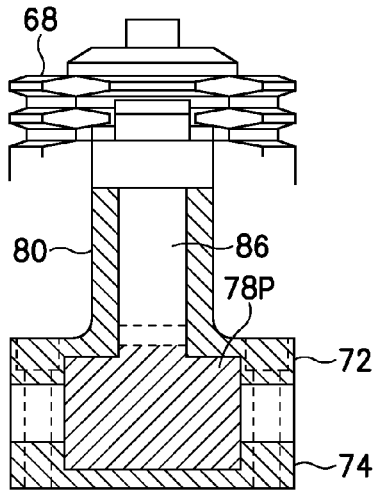
FIGS. 3A and 3B are sectional views taken on the lines A-A and B-B of FIG. 3.
Figure 3B:
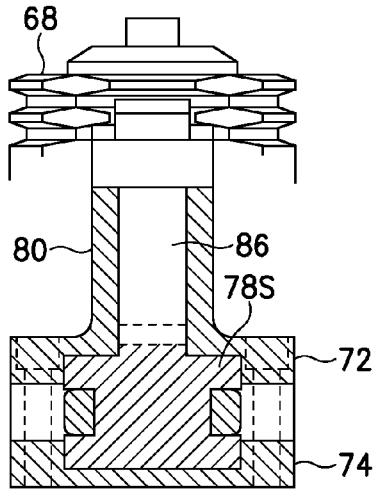

FIG. 2 illustrates a crankshaft for use in a radial engine comprising a main cylinder structure (not shown) defining five cylinders containing respective pistons. The crankshaft 6 converts reciprocating movement of the pistons in the cylinders to rotation of the crankshaft.

The crankshaft 6 is a composite assembly including a main crankshaft segment 8, a crank web 10 and a pin 12. The crankshaft is journalled for rotation in the main cylinder structure about the central axis of the main crankshaft segment 8. The crankshaft 6 is provided with a means, such as a gear 14, for coupling power to a consuming device (not shown).

The crankshaft segment 8 is hollow and accommodates a ramp housing 18 that is slidable axially within the crankshaft segment 8 but is restrained against rotation relative to the segment 8.

The outer end of the crankshaft segment 8 (the right end as seen in FIG. 2) is provided with a sleeve bearing 22. The outer end of the ramp housing accommodates a ball thrust bearing 24, which is aligned with the slide bearing 22. A cylindrical operating shaft 28 is secured to the ball thrust bearing 24 by a bolt 26 and extends through the slide bearing 22 and is coupled to an adjustment mechanism (not shown) for displacing the operating shaft axially relative to the crankshaft segment 8. The adjustment mechanism may be, for example, hydraulic or electromechanical.

At its inner end (the left end seen in FIG. 2), the crankshaft segment 8 is attached to the crank web 10 and contains a lever support insert 30. The lever support insert 30 is stationary relative to the crankshaft 6 and includes two transverse mounting walls 32 (only one of which is shown) which are parallel and are spaced from each other and are located to opposite sides of the central axis of the crankshaft segment 8. A lever 34 is disposed between the walls 32 and is pivotable relative to the insert 30 about a fulcrum pin 36 that is supported in the walls 32. A pin 38 is attached to the outer (right) end of the lever and projects to opposite sides of the lever.

The ramp housing 18 is pocketed at its inner (left) end and has two interior walls 40 formed with parallel ramp slots 42 in which the ends of the pin 38 are fitted and are able to slide. Thus, as the operating shaft 28 is moved axially relative to the crankshaft, the ramp housing moves axially of the crankshaft segment 8 and the pin 38 moves along the ramp slots. The lever 34 turns in the clockwise direction in the case of the operating shaft moving to the right relative to the crankshaft segment 8 and conversely if the operating shaft moves to the left, the lever turns in the counterclockwise direction.

At its left end, as seen in FIG. 2, the lever 34 projects through an opening in the crankshaft web 10 and is provided at its projecting end with a ball or knob 44. The crankshaft web 10 includes a base 46 that is attached to the crankshaft segment 8 and a dovetail tenon 48 projecting from the base and extending perpendicular to the axis of rotation of the crankshaft. A gear rack 50 is attached to the base 46 and extends parallel to the dovetail tenon 48.

The crank pin 12 includes a primary rod journal 52 formed with a dovetail groove in which the dovetail tenon 48 slides, whereby the primary rod journal 52 is movable linearly relative to the crankshaft segment 8 perpendicular to the axis of rotation of the crankshaft. The primary rod journal is also formed with a recess that receives the ball 44. Engagement of the ball in the recess transmits pivotal movement of the lever 34 to the primary rod journal. When the lever turns in the clockwise direction due to movement of the operating shaft 28, the primary rod journal 52 slides outward (relative to the central axis of the main crankshaft segment) along the dovetail tenon and conversely when the lever turns in the counterclockwise direction the primary rod journal slides inward along the dovetail slide.

The primary rod journal 52 is formed with a pocket that is traversed by a pinion shaft 54 extending perpendicular to both the dovetail groove and the axis of rotation of the crankshaft. A pinion 56 mounted on the shaft 54 meshes with the gear rack 50. When the primary rod journal 52 moves out (or in) along the dovetail slide, engagement of the gear rack 50 and pinion 56 causes clockwise (or counterclockwise) rotation of the pinion 56.

The primary rod journal 52 is formed with a bore that communicates with the pocket. A spindle post 60 is slidable in the bore parallel to the central axis of the crankshaft segment 8. The spindle post is formed with a clearance slot for receiving the pinion 56 and is provided at the base of the slot with a gear rack 62 that meshes with the pinion 56. When the primary rod journal 52 moves outward along the dovetail slide, the pinion 56 turns in the clockwise direction and consequently the spindle post 60 moves to the left of FIG. 2. Conversely, when the primary rod journal moves inward, the spindle post moves to the right.

The left end of the spindle post is provided with ball thrust bearings 64, which are secured to the spindle post by a bolt 66 and a washer and support a multifaced gear rack 68 having five faces, each provided with a gear rack segment. The bearings 64 allow relative rotation of the gear rack 68 and spindle post 60.

A primary rod assembly 70 is mounted on the primary rod journal 52 by a primary rod assembly journal bearing 71, which allows relative rotation of the primary rod assembly 70 and primary rod journal 52. The primary rod assembly 70 includes a hollow cylindrical pedestal support plate 72 and a 5-station (one primary and four secondary) base plate 74 attached to the pedestal support plate.

The five stations of the base plate 74 are associated with the five cylinders respectively of the engine. Each piston is provided with a connecting rod 76. One of the connecting rods is designated the primary connecting rod 76P; the other four connecting rods are secondary connecting rods 76S. The primary connecting rod is rigidly attached at its inner end to a primary connecting rod carriage 78P. Each secondary connecting rod is attached at its inner end to a secondary connecting rod carriage 78S by a bearing that allows pivotal movement of the connecting rod 76S relative to the connecting rod carriage 78S about an axis that is parallel to the axis of rotation of the crankshaft. The five stations of the base plate accommodate the five connecting rod carriages 78 respectively and each station permits sliding radial movement of the carriage relative to the base plate. The pedestal support plate 72 and the base plate 74 include formations 80 that guide movement of the connecting rod carriage relative to the base plate.

Each connecting rod carriage 78 includes a gear rack 82. At each station the pedestal support plate 72 includes sidewalls 80 that project to the left of the carriages and support a shaft 84 on which a two-sector gear 86 is mounted for rotation about an axis that is radially spaced from, and perpendicular to, the central axis of the spindle post 60. The two-sector gear has one sector that engages the gear rack 82 and another sector that engages one face of the gear rack 68. The two-sector gear 86 converts axial movement of the post 60 to radial movement of the connecting rod carriages 78. Thus, in the event that the post 60 moves to the left of FIG. 2, the connecting rod carriages are displaced radially inward relative to the central axis of the post 60 and conversely if the post 60 moves to the right, the connecting rod carriages are displaced radially outward.

In operation of the engine, the connecting rod carriages 78 remain stationary relative to the central axis of the post 60 as long as the operating shaft 28 remains stationary relative to the crankshaft segment 8.

Suppose the operating shaft is in the position shown in FIG. 2 and accordingly the lever 34 is aligned with the crankshaft segment 8. The primary piston is at top dead center of its range of reciprocation. The crown of the primary piston is at a distance T from the central axis of the shaft segment 8. The eccentricity $E_0$ of the crankshaft is equal to the distance between the central axis of the post 60 and the central axis of the shaft segment 8. When the crankshaft has turned through 180°, the primary piston is at bottom dead center and the crown of the piston is at a distance $T-2E_0$ from the central axis of the crankshaft segment 8. The range of movement of the crown of the piston is thus equal to $2E_0$. Now suppose the operating shaft 1 is moved in the direction of the arrow and, through the action of the ramp slots 42 and lever 34, the primary rod journal is moved radially outward by a distance e and consequently the eccentricity of the crankshaft changes to $E_0$+e. Due to the interaction of the gear rack 50 and gear rack 62 through the pinion 56, the spindle post 60 is displaced axially by a distance e and due to the interaction of the multifaced gear rack 68 and the gear rack 82 through the two-sector gear 86, the primary connecting rod carriage 78P is displaced radially inward by a distance e. At top dead center, the crown of the primary piston is at a distance T from the central axis of the crankshaft segment 8, and the range of movement of the crown of the primary piston is from T to T−2* ($E_0$+e). It will be appreciated that action at the four secondary stations is similar to that at the primary station. Thus, the mechanism shown in FIG. 2 allows the stroke of the pistons to be selectively varied by axial movement of the operating shaft 28 without changing the top dead center position of the pistons.

It will be appreciated that the invention is not restricted to the particular embodiment that has been described, and that variations may be made therein without departing from the scope of the invention as defined in the appended claims and equivalents thereof. For example, if the radius of the sector of the gear 86 that engages the rack 82 were different from the radius of the sector that engages the teeth of the multifaced gear rack 68, the interaction of the multifaced gear rack 68 and racks 82 through the two-sector gear segments 86 would result in movement of the connecting rod carriages 78 by an amount that is not equal to the displacement of the primary rod journal 52 along the dovetail slide. In addition, the invention is not restricted to use of a ramp and lever mechanism for converting axial movement of the operating shaft 28 to radial movement of the crank pin 12, since other mechanisms, such as a rack and pinion mechanism similar to that employed for converting radial movement of the primary rod journal to axial movement of the spindle post, may be used instead. Moreover, the invention is not restricted to use with a radial engine. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

The invention claimed is:

1. An internal combustion engine comprising:

a cylinder structure defining a combustion cylinder having a central axis, a piston fitted slidingly in the combustion cylinder for reciprocation therein, a crankshaft assembly including a main crankshaft segment having a main axis, a crank web that is attached to the main crankshaft segment and projects from the main crankshaft segment, and a crank pin structure that is attached to the crank web and has a central axis that is parallel to said main axis and is spaced from said main axis by a distance D, the crankshaft assembly being journalled in the cylinder structure for rotation about said main axis, an elongate connecting rod extending substantially radially of the crank pin structure and having an outer end attached to the piston and also having an inner end, a first mechanism attaching the inner end of the connecting rod to the crank pin structure, whereby reciprocation of the piston induces rotation of the crankshaft structure about said main axis, and a second mechanism for selectively adjusting the distance D, and wherein the first mechanism permits substantially longitudinal movement of the connecting rod relative to the crank pin structure, and wherein the second mechanism is coupled to the first mechanism in a manner such that an increase in the distance D is associated with longitudinal movement of the connecting rod toward the central axis of the crank pin structure and a decrease in the distance D is associated with longitudinal movement of the connecting rod away from the central axis of the crank pin structure.

2. An engine according to claim 1, wherein the second mechanism is coupled to the first mechanism in a manner such that an increase in the distance D is associated with longitudinal movement of the connecting rod by an equal amount toward the central axis of the crank pin structure and a decrease in the distance D is associated with longitudinal movement of the connecting rod by an equal amount away from the central axis of the crank pin structure.

3. An engine according to claim 1, wherein the crank pin structure is attached to the crank web in a manner permitting sliding movement of the crank pin structure relative to the crank web radially of the main crankshaft segment, and the second mechanism is effective between the main crankshaft segment and the crank pin structure for selectively displacing the crank pin structure relative to the main crankshaft segment.

4. An engine according to claim 3, wherein the crank pin structure comprises a connecting rod journal, a spindle post fitted slidingly in the connecting rod journal, and the first mechanism comprises an axial displacement mechanism for displacing the spindle post axially in response to displacement of the connecting rod journal and a radial displacement mechanism for displacing the connecting rod radially in response to axial displacement of the spindle post.

5. An engine according to claim 4, wherein the axial displacement mechanism comprises a first gear rack attached to the crank web and having teeth that are spaced apart along the direction of sliding movement of the connecting rod journal, a second gear rack attached to the spindle post and having teeth spaced apart along the direction of displacement of the spindle post, and a pinion journalled to the connecting rod journal and in meshing engagement with the first and second gear racks.

6. An engine according to claim 4, comprising a connecting rod carriage attached to the connecting rod at the inner end thereof, the connecting rod carriage being mounted to the connecting rod journal in a manner permitting radial movement of the connecting rod carriage relative to the connecting rod journal.

7. An engine according to claim 6, wherein the radial displacement mechanism comprises a first gear rack attached to the spindle post and having teeth that are spaced apart along the direction of displacement of the spindle post, a second gear rack attached to the connecting rod carriage and spaced apart radially of the connecting rod journal, and a gear member having first teeth in meshing engagement with the first gear rack and second teeth in meshing engagement with the second gear rack.

8. An engine according to claim 7, wherein the gear member is a two-sector gear having a first sector provided with said first teeth and a second sector provided with said second teeth, and the first sector is the same radius as the second sector.

9. An engine according to claim 7, wherein the gear member is a two-sector gear having a first sector provided with said first teeth and a second sector provided with said second teeth, and the first sector is different in radius from the second sector.

10. An engine according to claim 1, wherein the main crankshaft segment is hollow and defines an interior space that contains at least part of the second mechanism.

11. An engine according to claim 10, wherein the crank pin structure is attached to the crank web in a manner permitting sliding movement of the crank pin structure relative to the crank web radially of the main crankshaft segment and the second mechanism includes a lever having a fulcrum in the interior space of the main crankshaft segment and a free end that engages the crank pin structure, and a means for effecting pivotal movement of the lever about the fulcrum.

12. An engine according to claim 10, wherein the crank pin structure is attached to the crank web in a manner permitting sliding movement of the crank pin structure relative to the crank web radially of the main crankshaft segment and the second mechanism includes a lever having a first end in the interior space of the main crankshaft segment, an opposite second end that engages the crank pin structure, and a fulcrum in the interior space of the main crankshaft segment and intermediate the first and second ends, and the second mechanism also includes a ramp member having a ramp slot that is inclined to the axis of the main crankshaft segment and is engaged by the first end of the lever as a follower, and a means for effecting movement of the ramp member axially of the main crankshaft segment.

13. A radial-piston internal combustion engine comprising:

a cylinder structure defining a primary combustion cylinder and a plurality of secondary combustion cylinders, each combustion cylinder having a cylinder axis extending radially of a central axis and the cylinder axes being angularly spaced from each other about the central axis, a primary piston fitted slidingly in the primary combustion cylinder for reciprocation therein, a plurality of secondary pistons fitted slidingly in the secondary combustion cylinders respectively for reciprocation therein, a crankshaft assembly including a main crankshaft segment having a main axis that coincides with the central axis of the cylinder structure, a crank web that is attached to the main crankshaft segment and projects from the main crankshaft segment, and a primary rod journal that is attached to the crank web and has a central axis that is parallel to said main axis and is spaced from said main axis by a distance D, the crankshaft assembly being journalled in the cylinder structure for rotation about said central axis, a primary connecting rod extending substantially radially of the primary rod journal and having an outer end attached to the primary piston and also having an inner end, a first mechanism attaching the inner end of the connecting rod to the primary rod journal, whereby reciprocation of the primary piston induces rotation of the crankshaft assembly about said central axis, a plurality of secondary connecting rods connecting the secondary pistons respectively to the primary rod journal, and a second mechanism for selectively adjusting the distance D, and wherein the first mechanism permits movement of the primary connecting rod relative to the primary rod journal substantially radially of the primary rod journal, and wherein the second mechanism is coupled to the first mechanism in a manner such that an increase in the distance D is associated with movement of the primary connecting rod toward the central axis of the primary rod journal and a decrease in the distance D is associated with movement of the primary connecting rod away from the central axis of the primary rod journal.

* * * * *